US011877659B2

(12) United States Patent
Hwang

(10) Patent No.: US 11,877,659 B2
(45) Date of Patent: Jan. 23, 2024

(54) CHAIR FOR REDUCING LOAD ON BUTTOCKS AND WAIST

(71) Applicant: Jongsung Hwang, Bucheon-si (KR)

(72) Inventor: Jongsung Hwang, Bucheon-si (KR)

( * ) Notice: Subject to any disclaimer, the term of this patent is extended or adjusted under 35 U.S.C. 154(b) by 0 days.

(21) Appl. No.: 17/785,917

(22) PCT Filed: Apr. 6, 2021

(86) PCT No.: PCT/KR2021/004283
§ 371 (c)(1),
(2) Date: Jun. 16, 2022

(87) PCT Pub. No.: WO2021/206420
PCT Pub. Date: Oct. 14, 2021

(65) Prior Publication Data

US 2023/0043045 A1 Feb. 9, 2023

(30) Foreign Application Priority Data

Apr. 9, 2020 (KR) ..... 10-2020-0043684

(51) Int. Cl.
*A47C 1/025* (2006.01)
*A47C 7/40* (2006.01)
*A47C 1/032* (2006.01)

(52) U.S. Cl.
CPC ..... *A47C 1/025* (2013.01); *A47C 1/03211* (2013.01)

(58) Field of Classification Search
CPC ..... A47C 1/025; A47C 1/03211; A47C 7/402; A47C 7/462; A47C 7/144; A47C 7/441; A47C 1/024; A47C 1/0242; A47C 7/42; A47C 7/48; A61G 5/1067
USPC ..... 297/357, 285, 289, 291, 354.1, 354.11, 297/354.12, 361.1, 362
See application file for complete search history.

(56) References Cited

U.S. PATENT DOCUMENTS 3,401,979 A * 9/1968 Ulrich ..... B60N 2/2252 297/362
3,441,313 A * 4/1969 Persson ..... B60N 2/22 297/374

(Continued)

FOREIGN PATENT DOCUMENTS

CN 101548824 A * 10/2009 ..... A47C 1/023
JP 2003-038284 A 2/2003

(Continued)

OTHER PUBLICATIONS

PDF of an English translation of the Written Opinion dated Jul. 8, 2021 for parent application PCT/KR2021/004283. (Year: 2021).*

(Continued)

*Primary Examiner* — Robert Canfield
(74) *Attorney, Agent, or Firm* — Revolution IP, PLLC

(57) ABSTRACT

A chair for reducing a load on the buttocks and the waist, and, to a chair (100) includes a seat (110) and a backrest (130) and further comprising a spacer (120) protruding upward from the rear end of the seat (110), wherein the bottom of the backrest (130) is provided on the top of the spacer (120) so as to be tiltable rearward, and the point at which the angle of the backrest (130) is adjusted with respect to the spacer (120) corresponds to a point (P) at which the lumbar of a user body sitting on the seat (110) is curved inward.

3 Claims, 3 Drawing Sheets

(56) References Cited

U.S. PATENT DOCUMENTS 3,544,160 A * 12/1970 Karasick ..... A47C 1/027 297/354.1
4,143,912 A * 3/1979 Kramer ..... B60N 2/2252 297/362
4,157,203 A * 6/1979 Ambasz ..... A47C 7/448 297/285
4,541,672 A * 9/1985 Fukuta ..... B60N 2/2352 297/378.12
4,603,904 A * 8/1986 Tolleson ..... A47C 7/44 297/285
4,709,963 A * 12/1987 Uecker ..... A47C 1/03266 297/316
4,763,951 A * 8/1988 Silverman ..... A61G 5/1091 297/452.28
5,755,491 A * 5/1998 Baloche ..... B60N 2/2358 297/367 R
5,967,611 A * 10/1999 York ..... B60N 2/2213 297/367 R
6,168,235 B1 * 1/2001 Freund ..... B60N 2/2252 297/361.1
6,331,034 B1 * 12/2001 Specht ..... B60N 2/02246 297/362.11
6,629,732 B1 * 10/2003 Ursel ..... B60N 2/225 297/362.11
7,000,987 B2 * 2/2006 Staarink ..... A47C 7/46 297/354.11
7,104,607 B2 * 9/2006 Yasuda ..... B60N 2/2222 297/285
7,611,436 B2 * 11/2009 Ito ..... B60N 2/1867 475/180
8,052,215 B2 * 11/2011 Ito ..... B60N 2/02246 297/354.12
8,434,823 B2 * 5/2013 Du ..... B60N 2/2252 297/354.12
8,602,496 B2 * 12/2013 Lu ..... A47C 7/448 297/285
8,845,029 B2 * 9/2014 Voelz ..... B60N 2/22 297/362.11
9,149,120 B2 * 10/2015 Crofts ..... A47C 1/025
10,144,313 B2 * 12/2018 Ito ..... B60N 2/2252
10,486,555 B2 * 11/2019 Iwatate ..... B60N 2/2231
10,500,111 B1 * 12/2019 Ludovici ..... A61G 5/1067
10,638,846 B2 * 5/2020 Smith ..... A47C 1/0244
11,166,554 B1 * 11/2021 Romero ..... A47C 7/56
11,337,525 B1 * 5/2022 Wu ..... A47C 7/448
2003/0057757 A1 * 3/2003 Martin ..... A47C 1/023 297/354.12
2003/0062754 A1 * 4/2003 Yamada ..... B60N 2/68 297/354.1
2004/0239169 A1 * 12/2004 De Nichilo ..... B60N 2/206 297/378.12
2006/0202535 A1 * 9/2006 Heidmann ..... A47C 7/46 297/354.1
2007/0222265 A1 * 9/2007 Machael ..... A47C 1/023 297/300.2
2008/0315653 A1 * 12/2008 Brunner ..... B60N 2/832 297/362
2009/0091173 A1 * 4/2009 Mackert ..... A47C 31/126 297/354.1
2014/0001805 A1 * 1/2014 Crofts ..... A47C 17/12 297/354.1
2015/0307005 A1 * 10/2015 Dill ..... B60N 2/3011 297/354.1
2016/0296392 A1 * 10/2016 Moller ..... A61G 5/10
2018/0111513 A1 * 4/2018 Scott ..... B60N 2/02246
2018/0111516 A1 * 4/2018 Lin ..... B60N 2/2213
2018/0281633 A1 * 10/2018 Gabalski ..... B60N 2/2213
2019/0323590 A1 * 10/2019 Sakaguchi ..... F16H 1/16
2020/0383485 A1 * 12/2020 Snyder ..... A47C 7/407

FOREIGN PATENT DOCUMENTS

KR 20-0298198 Y1 12/2002
KR 20-0431249 Y1 11/2006
KR 20-2009-0000268 U1 1/2009
KR 10-2013-0078931 A 7/2013
KR 20-2014-0000574 U1 1/2014
KR 10-1690054 B1 12/2016

OTHER PUBLICATIONS 14 page PDF of machine translation of KR 10-2013-0078931 to Baek (Year: 2013).*
International Search Report for PCT/KR2021/004283 dated Jul. 8, 2021 from Korean Intellectual Property Office.

* cited by examiner

CHAIR FOR REDUCING LOAD ON BUTTOCKS AND WAIST

TECHNICAL FIELD

The present invention relates to a backrest chair capable of adjusting an angle, and more particularly, to a chair for reducing a load of the buttocks and the waist suitable to minimize a load applied to the buttocks and the waist when sitting by configuring a backrest capable of adjusting an angle to be tilted from the lumbar of a user which is a point higher than a seat by a predetermined height instead of being tilted from the seat (corresponding to the tailbone of the user).

BACKGROUND ART

In general, a chair is a device used by a person to sit, and configured by a seat for supporting the buttocks when sitting and a backrest provided at the rear side of the seat to support the waist of a user. In some cases, the chair is additionally configured by legs or a neck support below the seat, and the legs are fixed or easily movable with a caster provided at the bottom, and the neck support is variously configured depending on the purpose of use, such as supporting the head of the user.

In such a chair, there are disclosed various waist support-type chairs for supporting the waist when the user sits on the chair.

For example, there is a chair that is formed to protrude from both sides to have a certain depth in the center of the backrest so that the waist is seated when the user leans on the back.

Such a waist support-type chair supports only the waist of a sitting user, so there is a limit in comfort or convenience, and there is also a technical limit in that the chair cannot completely remove the load applied to the waist.

In addition, for example, a backrest chair capable of adjusting a titled angle, such as a seat of a car, has been known. Such an angle-adjustable backrest chair may adjust the titled angle by tilting the backrest backward.

In the case of a conventional angle-adjustable backrest chair, since a point at which the backrest is bent to adjust the angle is bent at the seat (a part where the buttocks are seated), there was a technical problem in that the waist of the user (sitter) is not supported accurately, and the load applied to the waist was transmitted to the waist as it is.

That is, in the conventional angle-adjustable backrest chair, since the angle of the backrest is adjusted in the tailbone of the sitter, there is physical pain for a long time by pressing the spine and the buttocks with the load of the upper body for a long time when the chair is used.

In addition, in the case of the conventional angle-adjustable backrest chair (for example, a chair other than a fixing-type chair such as a car seat as an office (student) chair), when the backrest was tilted backward from 90° to 180°, there was a problem in that the chair may fall backward due to an imbalance in the center of gravity between the upper body and the backrest. In addition, since the backrest needs to be greatly tilted backward, there was a problem in that the space occupied when the backrest was unfolded was increased.

Meanwhile, a frequency of using airplanes, long-distance buses (express buses, intercity buses), and high-speed trains even among transportation means has been increased due to the diversification of life, the work, and the like of modern people.

In chairs provided on airplanes, long-distance buses (express buses, intercity buses), and high-speed trains, since there is a limitation in the size of the angle at which the backrest is tilted, when sitting for a long time, a lot of load is applied to the waist, and the seating comfort is not good, and there is also discomfort.

In addition, when sitting in the chairs provided for airplanes, buses, cars, and high-speed trains and traveling for a long distance, the load of the upper body is transmitted to the buttocks, and the sitter suffers from the pressure of the buttocks due to the transmission of the load.

Patent Document 1: Korean Patent Registration No. 10-1690054 (issued on Dec. 27, 2016)

Patent Document 2: Korean Utility Model Registration No. 20-0431249 (published on Nov. 23, 2006)

DISCLOSURE

Technical Problem

The present invention is created to solve the problems in the related art, and objects of a chair for reducing a load of the buttocks and the waist according to the present invention are as follows:

First, the chair is formed so that a point at which an angle of the backrest is adjusted by a spacer coincides with a point where the lumbar of a user is curved inward (toward the body) to support both the back and the waist of the user, thereby reducing or completely removing a load applied to the buttocks and the waist.

Second, the chair is configured so that the backrest is not tilted from a seat, but an angle of the backrest is adjusted from a part higher than the seat by a preset height, that is, accurately the lumbar to significantly remove the load applied to the buttocks and the waist, thereby leaning on the backrest while supporting the waist.

Third, by using the characteristic of the lumbar joint, which bends behind the lumbar, which consists of several joints, the load of the upper of the user is distributed on the backrest of which the angle is adjusted so as to relieve the pain of the waist and the buttocks that are pressed for a long time and provide a comfortable sleep effect.

Fourth, since the upper body of the upper part of the lumbar is tilted backward when the backrest is tilted backward, the balance may be maintained, thereby maintaining the stability.

Fifth, since the upper body of the upper part of the lumbar is tilted backward when the backrest is tilted backward, even if the backrest is tilted at a small tilting angle (p), there is the same effect as when a conventional chair backrest is tilted backward at a large angle, thereby making a unfolded occupying space relatively small.

Sixth, since it is required to place the chairs in a limited space in aircraft or automobiles when the present invention is applied chairs of airplanes or automobiles, it is possible to provide a chair for reducing a load of the buttocks and the waist suitable to make better use of a space, reduce pain in the body pressed to the waist or the buttocks, and provide more comfortable rest and long-term sleep.

Technical Solution

An aspect of the present invention provides a chair for reducing a load on the buttocks and the waist comprising a seat and a backrest and further comprising a spacer protruding upward from the seat, wherein the bottom of the backrest is provided on the top of the spacer so as to be tiltable rearward, and a point at which the angle of the backrest is adjusted with respect to the spacer corresponds to a point at which the lumbar of a user body sitting on the seat is curved inward.

Advantageous Effects

According to the present invention, the chair for reducing the load of the buttocks and the waist having such a configuration has the following effects.

First, the chair is formed so that a point at which an angle of the backrest is adjusted by a spacer coincides with a point where the lumbar of a user is curved inward (toward the body) to support both the back and the waist of the user, thereby reducing or completely removing a load applied to the buttocks and the waist.

Second, in the backrest chair capable of adjusting the tilted angle, the chair is configured so that the backrest is not tilted from a seat, but an angle of the backrest is adjusted from a part higher than the seat by a preset height, that is, accurately the lumbar to completely minimize the load applied to the buttocks and the waist, thereby leaning on the backrest while supporting the waist.

Third, in the case where the present invention is implemented as chairs in automobiles or trains, when sitting for a long time due to a long moving time, since there is no load applied to the waist, it is more effective for moving in a sitting state for a long time.

Fourth, by using the characteristic of the lumbar joint, which bends behind the lumbar, which consists of several joints, the load of the upper of the user is distributed on the backrest of which the angle is adjusted so as to relieve the pain of the waist and the buttocks that are pressed for a long time and provide a comfortable sleep effect.

Fifth, in the case of the conventional angle-adjustable office (student) chair, when the backrest was tilted backward from 90° to 180°, there was a problem in that the chair may fall backward due to an imbalance in the center of gravity between the upper body and the backrest. However, in the case of using the chair for reducing the load of the buttocks and the waist according to the present invention as the office (student) chair, since the upper body of the upper part of the lumbar is tilted backward even if the backrest is tilted backward, the balance may be maintained, thereby maintaining the stability.

Sixth, since the upper body of the upper part of the lumbar is tilted backward when the backrest is tilted backward, even if the backrest is tilted at a small tilting angle (p), the same effect as when a conventional chair backrest is tilted backward at a large angle occurs to make a unfolded occupying space relatively small, thereby enhancing the use of a space.

Seventh, since it is required to place the chairs in a limited space in aircraft or automobiles when the present invention is applied chairs of airplanes or automobiles, it is possible to make better use of a space, reduce pain in the body pressed to the waist or the buttocks, and provide more comfortable rest and long-term sleep.

MODES FOR THE INVENTION

Figure 1:
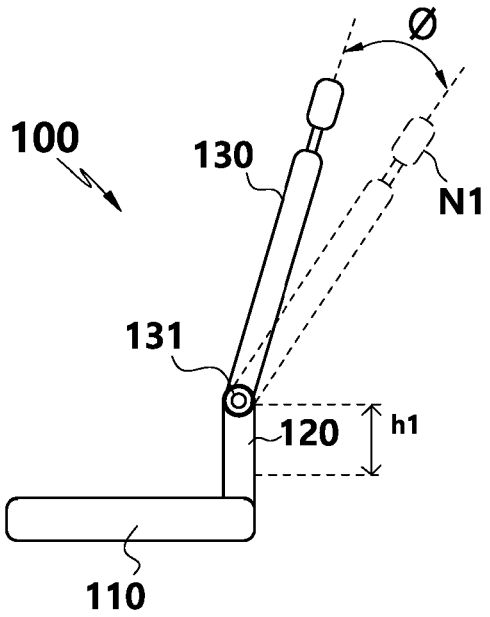
FIG. 1 is a schematic diagram of a configuration viewed from the side of a chair 100 for reducing the load of the buttocks and the waist according to an embodiment of the present invention and an operation diagram illustrating a tilting operation of a backrest 130.

Hereinafter, a preferred embodiment of a chair for reducing a load of the buttocks and the waist of the present invention will be described in detail with reference to the accompanying drawings.

A chair 100 for reducing a load on the buttocks and the waist according to an embodiment of the present invention is configured to include a seat 110 on which a user sits and a backrest 130 and to further include a spacer 120 formed to protrude upward from the rear end of the seat 110. The bottom of the backrest 130 is provided on the top of the spacer 120 so as to be tiltable rearward, and a point at which the angle of the backrest 130 is adjusted with respect to the spacer 120, that is, specifically a rotation shaft 131 corresponds to a point P at which the lumbar of a user body sitting on the seat 110 is curved inward.

According to this, since the point at which the angle of the backrest 130 is adjusted with respect to the spacer 120, that is, the rotation shaft 131 corresponds to a point P1 at which the lumbar of the user is curved inward (toward the body), both the back and the waist of the user may be supported to reduce or completely remove the load applied to the buttocks and the waist when sitting.

Particularly, the backrest 130 is configured so that the angel is not adjusted at the seat 110 (a tailbone part of a sitter), but the angle is adjusted at a part higher than the seat 110 by a preset height h1, that is, the top of the spacer 120, accurately the lumbar to significantly remove the load applied to the buttocks and the waist, thereby leaning on the backrest while supporting the waist.

Third, in the case where the chair 100 of the present invention is implemented as chairs in automobiles or trains, when sitting for a long time due to a long moving time, since there is no load applied to the waist, it is more effective for moving in a sitting state for a long time.

Meanwhile, the chair 100 for reducing the load on the buttocks and the waist according to the embodiment of the present invention may also be configured to further include a neck support N1 provided on the top of the backrest 130, and as such, in the case of the neck support N1, the effect may be greater exhibited.

The angle (tilting angle) at which the backrest 130 is tilted is indicated by an angle φ.

As illustrated in FIG. 1, in the chair 100 for reducing the load on the buttocks and the waist according to the embodiment of the present invention, the spacer 120 is configured in a shape of two or more poles.

Meanwhile, in the chair 100 for reducing the load on the buttocks and the waist according to the embodiment of the present invention, although the spacer 120 is described as being formed in the shape of two poles as an example, it is not limited thereto, and for example, even if the spacer 120 is configured in a plate shape, of course, it belongs to the technical scope of the present invention.

Figure 4:
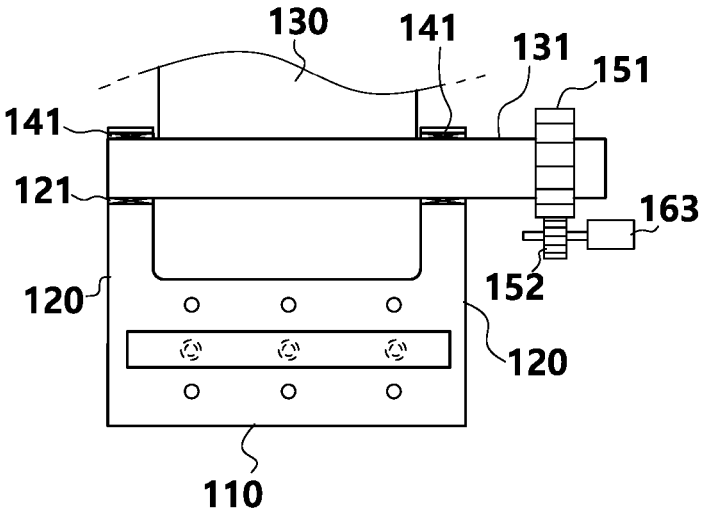
FIG. 4 is a schematic diagram of a configuration of main parts viewed from the front side in the chair 100 for reducing the load of the buttocks and the waist according to a modified embodiment of the present invention.
Figure 5:
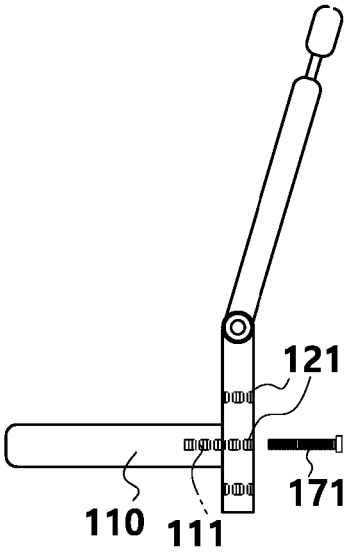
FIG. 5 is a schematic diagram of a configuration viewed from the side in the chair 100 for reducing the load of the buttocks and the waist according to a modified embodiment of the present invention illustrated in FIG. 4.

In addition, according to the embodiment, the lower side may be formed in a plate shape and the upper end may be formed in a pole shape (see FIG. 4).

Accordingly, as long as the spacer 120 may adjust the angle of the backrest from the upper side by the present height h1 from the seat 110 regardless of its shape, it belongs to the technical scope of the present invention.

The spacer 120 may be formed integrally with the seat 110 or may be provided upright on the seat 110 by a fastening member as a separate component.

The spacer 120 is characterized to be formed at a height h1 of 15 to 25 cm from the sheet 110.

In addition, the backrest 130 is characterized to be formed in a flat shape or a curved shape.

In the chair 100 for reducing the load on the buttocks and the waist according to the embodiment of the present invention, a configuration in which the backrest 130 is supported by the spacer 120 and rotates will be described in detail.

In the chair 100 for reducing the load on the buttocks and the waist according to the embodiment of the present invention, the rotation shaft 131 formed on the bottom of the backrest 130 is further included, and the spacer 120 is characterized to be provided rotatably on the rotation shaft 131.

In addition, a shaft hole 121 is formed in the spacer 120, and the rotation shaft 131 is rotatably provided in the shaft hole 121, so that the backrest 130 is rotatable on the spacer 120.

Furthermore, a bearing 141 may also be provided in the shaft hole 121 to facilitate rotation.

The chair 100 for reducing the load on the buttocks and the waist according to the embodiment of the present invention is configured to further include a tilting member for adjusting an angle (tilting angle) at which the backrest 130 is tilted with respect to the spacer 120.

The tilting member itself may be implemented as various tilting members known before the filing of the present invention.

For example, the tilting member may be configured to include a driven gear 151 axially provided on the rotary shaft 131, a driving gear 152 engaging with the driven gear 151, and driving sources 161 and 162 axially provided on the driving gear 152 to drive the driving gear 152.

Figure 2:
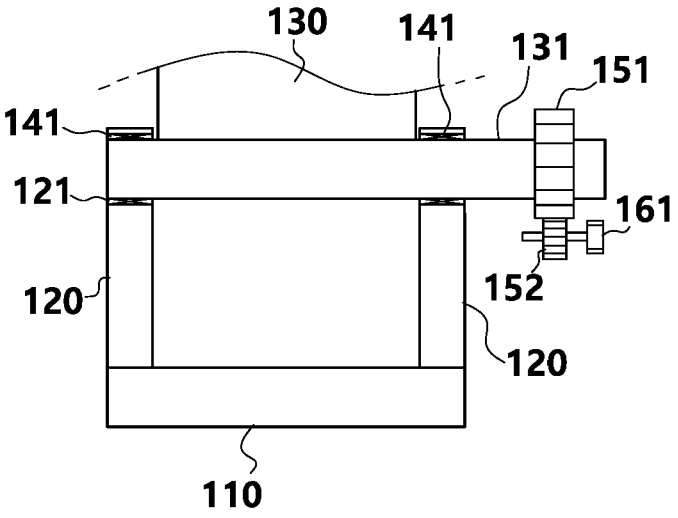
FIG. 2 is a schematic diagram of a configuration of main parts viewed from the front side in the chair 100 for reducing the load of the buttocks and the waist according to an embodiment of the present invention.

In addition, the drive source 161 may also be configured as a motor box 163 that is axially provided on the driving gear 152 to electrically turn the driving gear 152 (see FIG. 4), or the driving source 161 may also be configured as a lever 161 that is axially provided on the driving gear 152 to forcibly turn the driving gear 152 manually (see FIG. 2), and of course, any case belongs to the technical scope of the present invention.

The chair 100 for reducing the load on the buttocks and the waist according to the embodiment of the present invention is characterized to adopt the technology for adjusting the height of the spacer 120 according to a seated height of the sitter (user).

That is, the chair 100 for reducing the load on the buttocks and the waist according to the embodiment of the present invention is configured to further include a height adjustment member for adjusting the height h1 of the spacer 120 from the seat 110.

For example, the height adjustment member is configured to include a height adjustment hole 121 formed in the spacer 120 in multiple stages (three stages in the illustrated embodiment) in a height direction, a fastening hole 111 formed in the seat 110 to correspond to the height adjustment hole 121, and a fastening bolt 171 for screwing the height adjustment hole 121 and the fastening hole 111 together.

Meanwhile, in the chair 100 for reducing the load on the buttocks and the waist according to the embodiment of the present invention, it has been described that the height adjustment member is configured by the height adjustment hole 121, the fastening hole 111, and the fastening bolt 171, but it is not limited thereto, and for example, as long as the height adjustment member is a technology of adjusting the height of the spacer 120, of course, any case belongs to the technical scope of the present invention.

Next, the effect of the chair 100 for reducing the load on the buttocks and the waist according to the embodiment of the present invention having the configuration as described above will be described.

Figure 3:
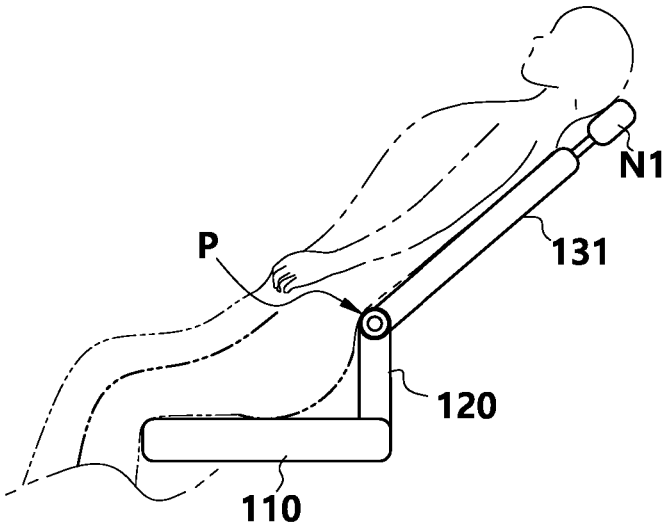
FIG. 3 is an exemplary diagram of a use state in which a user uses the chair 100 for reducing the load of the buttocks and the waist according to an embodiment of the present invention.

As illustrated in FIG. 3, when lying obliquely so that the waist side of the user is located on the rotation shaft 131, which is an approximately bent point and the back of the user is located at the backrest 130, the user feels very comfortable and easy as if lying in bed.

As described above, the preferred embodiment according to the present invention have been described, and it is apparent to those skilled in the art that the present invention may be implemented in other specific forms without changing the technical spirit or essential features in addition to the above-described embodiments. Therefore, it should be understood that the above-described embodiments are not restrictive but illustrative.

The scope of the present invention is represented by claims to be described below rather than the detailed description, and it is to be interpreted that the meaning and scope of the claims and all the changes or modified forms derived from the equivalents thereof come within the scope of the present invention.

The invention claimed is:

1. A chair for reducing a load on the buttocks and the waist, the chair (100) comprising:

a seat (110);

a backrest (130);

a spacer (120) protruding upward from a rear end of the seat (110), wherein the bottom of the backrest (130) is provided on the top of the spacer (120) so as to be tiltable rearward;

a rotation shaft (131) formed on the bottom of the backrest (130), wherein the spacer (120) is rotatably provided on the rotation shaft (131), wherein a shaft hole (121) is formed in the spacer (120), and the rotation shaft (131) is rotatably provided in the shaft hole (121) so that the backrest (130) is rotatable on the spacer (120), wherein the rotation shaft (131) is provided at which the angle of the backrest (130) is adjusted with respect to the spacer (120); and a tilting member for adjusting an angle at which the backrest (130) is tilted with respect to the spacer (120), the tilting member comprising:

a driven gear (151) axially provided on the rotation shaft (131);

a driving gear (152) engaging with the driven gear (151); and a driving source (161) axially provided on the driving gear (152) to drive the driving gear; and a height adjustment member for adjusting a height (h1) of the spacer (120) from the seat (110).

2. The chair for reducing the load on the buttocks and the waist of claim 1, wherein the height adjustment member comprises a height adjustment hole (121) formed in the spacer (120) in multiple stages in a height direction, a fastening hole (111) formed in the seat (110) to correspond to the height adjustment hole (121), and fastening bolt (171) for screwing the height adjustment hole (121) and the fastening hole (111).

3. The chair for reducing the load on the buttocks and the waist of claim 1, wherein the spacer (120) is formed in a shape of two or more poles.

* * * * *